US005881397A

United States Patent [19]

Hobbs

[11] Patent Number: 5,881,397

[45] Date of Patent: Mar. 16, 1999

[54] DRAIN CLOSURE

[75] Inventor: Billy J. Hobbs, Gardnerville, Nev.

[73] Assignee: LSP Products Group, Inc., Carson City, Nev.

[21] Appl. No.: 967,834

[22] Filed: Nov. 12, 1997

[51] Int. Cl.[6] ..... A47K 1/14

[52] U.S. Cl. ..... 4/287; 4/295; 4/689; 251/297; 403/375

[58] Field of Search ..... 4/295, 287, 293, 4/684, 685, 689, 690, 691, 92; 251/64, 297; 203/375, 376, 377, 378; 200/539

[56] References Cited

U.S. PATENT DOCUMENTS

| | | | |
|---|---|---|---|
| 2,090,299 | 8/1937 | Kuhnle . | |
| 2,385,016 | 9/1945 | Mercier | 251/297 X |
| 3,127,786 | 4/1964 | Wooley | 251/297 |
| 3,380,081 | 4/1968 | Eilertson et al. | 4/295 |
| 3,588,928 | 6/1971 | Hiertz . | |
| 3,972,078 | 8/1976 | Maki . | |
| 4,160,293 | 7/1979 | Niemann . | |
| 4,339,832 | 7/1982 | Cuschera | 4/287 |
| 4,369,531 | 1/1983 | Swanson | 4/295 |
| 4,720,877 | 1/1988 | Watts . | |
| 4,908,883 | 3/1990 | Rivera | 4/295 |
| 4,926,507 | 5/1990 | Craig et al. | 4/295 |
| 5,012,056 | 4/1991 | Abel et al. | 200/539 X |
| 5,072,461 | 12/1991 | Logsdon | 4/295 |
| 5,074,134 | 12/1991 | Wheadon | 251/297 X |
| 5,165,118 | 11/1992 | Cendrowski . | |
| 5,653,421 | 8/1997 | Ellzey | 251/297 X |

FOREIGN PATENT DOCUMENTS

| | | | |
|---|---|---|---|
| 2177908 | 2/1987 | United Kingdom | 4/295 |

*Primary Examiner*—Henry J. Recla
*Assistant Examiner*—Kathleen J. Prunner
*Attorney, Agent, or Firm*—Locke Purnell Rain Harrell, P.C.; Monty L. Ross

[57] ABSTRACT

A bathtub drain closure having a strainer element with an internally threaded recess that engages male threads on the lower end of an upwardly extending post. The post has at least one transverse passageway containing a polymeric pin having ends that project slightly beyond the ends of the passageway. A stopper having a centrally disposed, internal bore slides up and down the post between open and closed positions. The central bore of the stopper has a stepped profile having upper and lower portions with an internal diameter slightly greater than the length of the polymeric pin and a middle portion with an internal diameter slightly less than the length of the polymeric pin, thereby causing the pin to be compressed into frictional engagement with the central bore as the stopper slides up and down between the open and closed positions.

8 Claims, 3 Drawing Sheets

DRAIN CLOSURE

TECHNICAL FIELD

This invention relates to drain closures and more particularly to vandal resistant push-pull drain closures.

BACKGROUND OF THE INVENTION

Bath tub closures are of two basic types, trip lever and non-trip lever. A trip lever closure consists of a stopper connected by means of a linkage system to a trip lever handle mounted on the front end wall of the tub. The closure is opened and closed by raising or lowering the trip lever. The trip lever is susceptible to mechanical failure especially in high usage environments such as hotels.

Non-trip lever closures such as the push-pull drain closures disclosed herein require direct contact with a hand or foot to open and close and are less susceptible to mechanical failure. A disadvantage of some push-pull closures is that they are susceptible to pilfering in hotel usage. U.S. Pat. Nos. 4,926,507, 4,908,883 and 4,720,877 disclose push-pull drain closures made with threaded center posts to reduce pilfering. In U.S. Pat. Nos. 4,926,507 and 4,720,877, the center post is made with a metal spring element that provides the friction necessary to maintain the stopper portion of the drain closure in the desired position relative to the center post. The metal to metal contact during operation of these devices makes the up and down stopper action rough and scratchy. Although the drain stopper disclosed in U.S. Pat. No. 4,908,883 avoids this disadvantage by using elastomeric O-rings as frictional holding members, the soft O-rings degrade much more rapidly, necessitating more frequent replacement.

A center post drain closure is, therefore, needed that is both smoothly operating and resistant to wear and chemical attack.

SUMMARY OF THE INVENTION

The present invention comprises a drain closure for use with a drain having a strainer with a top annular flange and an internally threaded opening disposed in the bottom. The drain closure includes a post with a lower portion externally threaded for engagement with the internally threaded opening in the bottom of the strainer. In a first embodiment, the post includes an enlarged head formed integrally on the post. Alternatively, instead of an integrally formed head, the post may be threaded on the top end and a nut threaded thereon, wherein the nut serves as the enlarged head. This manner of construction has the added advantage that the thread size selected for the top of the post may be different from that of the thread size of the lower portion. The nut may be removed and the post reversed top to bottom and the formerly upper end threadedly engaged in the opening in the bottom of the strainer. A nut of mating thread size may be threaded on the former bottom end of the post (now the upper end) and serve as the head.

The post further includes at least one passageway passing through the post transverse to the longitudinal axis of the post. A polymeric pin is disposed in the transverse passageway wherein at least one end of the polymeric pin extends beyond the circumferential exterior surface of the post. The post includes at least one wrench flat for tightening the post in the strainer.

A stopper having a central internal bore receives the post for sliding movement thereon between open and closed positions. The bore further includes an upper threaded portion having an internal diameter larger than the diameter of the head of the post and a lower portion having an internal diameter smaller that the diameter of the head of the post, wherein the head on the post prevents the stopper from being lifted off of the post. A knob to facilitate lifting the stopper to an open position includes an internal cavity open to a bottom of the knob. The cavity has an internal diameter sufficient to receive the head of the post when the stopper is in positions between partially open and closed. The knob further includes an externally threaded lower portion for engaging the internally threaded upper portion of the bore of the stopper. The end of the polymeric pin frictionally contacts the central bore of the stopper and maintains the stopper in a selected position. The post is inaccessible for unscrewing from the strainer while the knob is threadedly engaged to the stopper.

Alternatively, the central bore of the stopper may have an upper portion with an internal diameter larger than the internal diameter of the middle section and a lower section with an internal diameter larger than the middle section. The internal diameter of the upper and lower portions of the central bore may be larger than the outside diameter of the post and the projecting portion of the polymeric pin mounted therein, such that when the stopper is fully open or fully closed the polymeric pin lands in the lower or upper portions of the central bore and is not in compression. When the stopper is in the open position the polymeric pin will land in a downwardly facing annular shoulder formed at the juncture of the lower and middle portions of the main central bore and hold the stopper in the open position. When the stopper is in the closed position, the polymeric pin will land in an upwardly facing annular shoulder formed at the junction of the upper and middle portions of the main central bore and acting in conjunction with gravity will hold the stopper in the closed position.

The stopper further includes a sleeve portion surrounding the central bore. The sleeve portion includes at least one wrench flat accessible by a wrench when the stopper is in the open position for facilitating tightening of the knob on the stopper. To a vandal, the knob and stopper appear to be a single integral unit thereby further inhibiting closure theft.

The stopper further includes a closure flange on the upper end of the stopper. The flange has an external diameter larger than an internal diameter of the strainer. A polymeric flange gasket is disposed on the upper end of the stopper and below the lower surface of the closure flange. The upper surface of the flange gasket contacts the lower surface of the closure flange, and the lower surface of the flange gasket contacts the flange of the strainer when the stopper is in the closed position to seal the drain. The transverse pin helps to maintain the closure in the closed position and thereby effects a more reliable seal between the closure and strainer body.

An alternate embodiment includes a molded polymeric post with a plurality of circumferentially spaced bumps disposed on the post, most preferably at least about 120 degrees apart. An interference fit between the bumps and the internal surface of the central bore of the stopper provides sufficient frictional force to maintain the closure in the desired raised position during draining.

The manner in which the drain closure is constructed and assembled reduces likelihood of closure theft. At the same time, the closure can be easily closed by hand or foot and can easily be opened by hand while the user is sitting in the bathtub. The stopper of the present invention has a smoother opening and closing action because the plastic to metal contact between the central bore of the metal stopper has less drag than that of the metal to metal or rubber to metal contact found in prior art stoppers of this type. Additionally, the plastic to metal contact will be less likely to score the metal surface of the central bore of the stopper and the plastic will be less susceptible than rubber to chloramine attack and degradation.

The present invention is considerably less complex than currently available foot actuated closures. There is no cycling of springs or other parts that can lead to metal fatigue or wear problems and even repeated, severe blows to the closure do not cause significant damage.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE INVENTION

Figure 1:
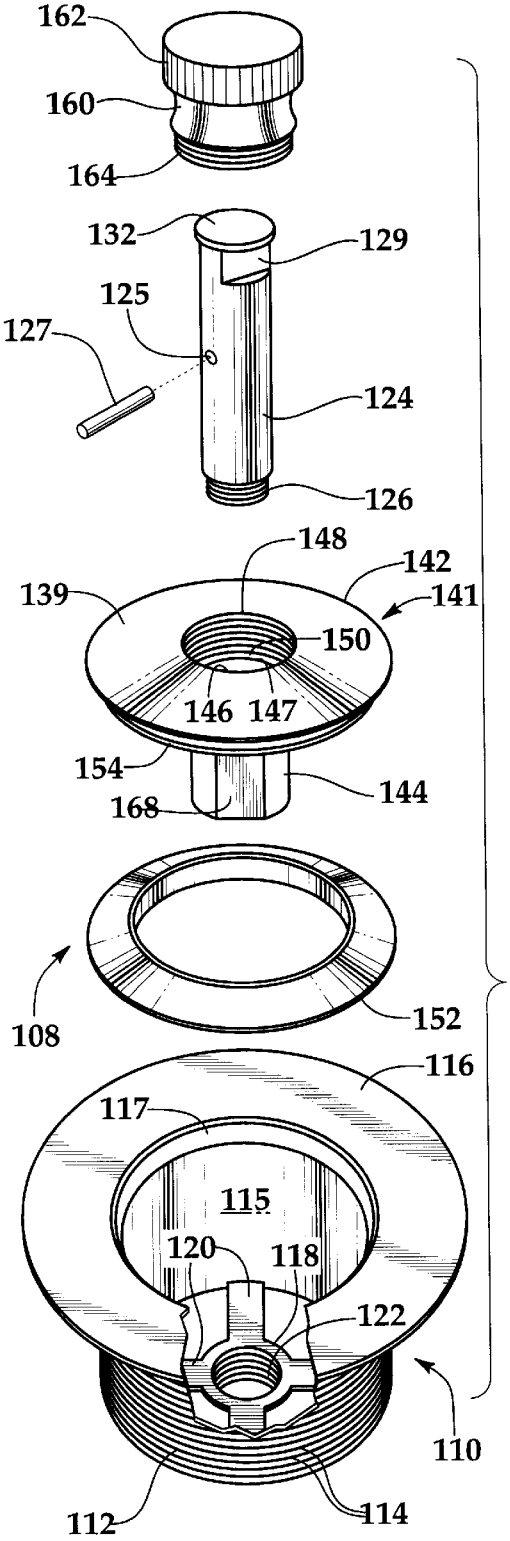
FIG. 1 is an exploded perspective view of a first embodiment of the bathtub drain closure constructed according to the present invention.

Reference is now made to the Drawings wherein like reference characters denote like or similar parts throughout the Figures.

Referring to FIGS. 1–4, a strainer 110 includes a cylindrical wall 112 which is externally threaded at 114 for threadedly engaging a drain fitting under the floor of a bathtub (or a sink, laundry tub or other drain opening). Within the strainer body, a drain passage 115 is provided for draining of liquid from the tub. The top edge of the strainer body 110 is provided with an annular flange 116. The top or entry to passage 115 is tapered or beveled as indicated by numeral 117, although it need not be. Formed within the lower portion of the strainer body is a ring 118 carried on a spider 120 secured to the inside surface of the wall 112. The ring 118 is concentric with wall 112 and has an internal female thread 122. In the preferred embodiment, the strainer is formed from metal; however, it will be appreciated that it may be formed from polymeric materials as well.

In the preferred embodiment, the drain closure 108 includes a machined metal post 124 having a male thread 126 on its bottom end that mate with the female thread 122 of ring 118 of the strainer 110. The post 124 can thus be threaded into ring 118 and mounted in this manner to extend along the central axis of the strainer body. The main body or shank of post 124 is cylindrical. A flat head 132 is formed on the upper end of post 124. The head 132 is enlarged in diameter compared to the shank of post 124.

Figure 9A:
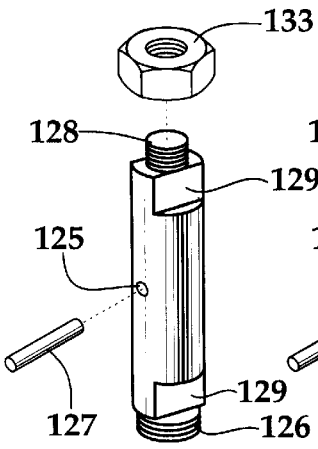
FIG. 9A is a perspective view illustrating an alternative embodiment of the post of the drain closure of FIG. 1.
Figure 9B:
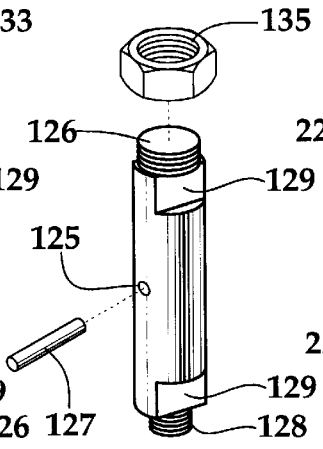
FIG. 9B is a perspective view illustrating the post of FIG. 9A reversed bottom to top.

Referring to FIGS. 9A and 9B, alternatively, instead of an integrally formed head 132, the post 124 may be threaded on the top end with thread 128 of a different diameter than the bottom thread 126 and a nut 133 threaded thereon, wherein the nut 133 serves as the enlarged head. This manner of construction has the added advantage that the thread size 128 selected for the top of the post may be different from that of the thread size 126 of the lower portion. The nut 133 may be removed and the post 124 reversed top to bottom and the formerly upper end threadedly engaged in a strainer 110 having a different thread size 122 in the ring 118. A nut of mating thread size 135 may be threaded on the former bottom end 126 of the post (now the upper end) and serve as the head. A wrench flat 129 is located on both ends of the post 124 for access when the post is reversed bottom to top. Thereby, the present invention may be retrofitted on pre-existing tub strainers having different size internal threads.

Referring again to FIGS. 1–4, the post 124 includes at least one passageway 125 passing through the post transverse to the longitudinal axis of the post. A polymeric pin 127 is disposed in the transverse passageway wherein at least one end of the polymeric pin extends beyond the circumferential exterior surface of the post 124. In the preferred embodiment, the polymeric pin 127 is formed from molded polytetrafluorethylene (Teflon®) but may be formed from ultra high density polyethylene (UHDPE), ultra high density polypropylene (UHDPP), polyester, acetal resin (either homopolymer or copolymer), ultra high molecular weight (UHMW) polymers including polyamides (NYLON®), or other similarly effective wear resistant polymeric resins. The pins 127 may be molded and then inserted into the post 124 or insert molded into the passageway 125. It will be understood by those skilled in the art that it is not necessary for passageway 125 to extend through post 124, but instead a plurality of blind end passageways formed in post 124 and polymeric pins 127 inserted therein may be used in the practice of this invention. It will also be understood by those skilled in the art that the pin is not required to have a circular cross section but may include any cross section such as square, rectangular, oval or "x" shaped.

Fitted on the post 124 is a forged brass or other metal stopper 141 having a disk shaped head 142 and an integral sleeve 144 projecting from its lower surface. The head 142 has an enlarged closure flange 139 forming its top surface. A cylindrical bore 146 is formed centrally through the stopper 141. A first portion 148 of the bore 146, disposed at the upper end of the bore 146, within head 142, is larger than the remainder of the bore and is internally threaded. An upwardly facing annular shoulder 150 is formed within the bore 146 at the lower end of the first portion 148 where it intersects with a second portion 147 of the central bore.

Figure 2:
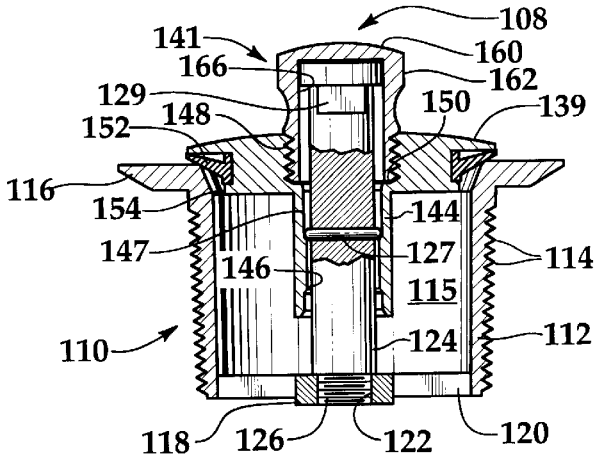
FIG. 2 is a sectional view of the assembled first embodiment of the drain closure of FIG. 1 taken on a vertical plane and showing the closure in the closed position.

The second portion of the bore 147 has a slightly larger diameter than the post 124, and the stopper 141 is received on post 124 for up and down sliding movement thereon between the open position (FIG. 3) and the closed position (FIG. 2). At the same time, the close fit of bore 146 on post 124 prevents the stopper assembly from wobbling. In addition, the fit of post 124 in bore 146 permits the stopper 141 to turn about the axis of the vertical post 124.

Figure 2A:
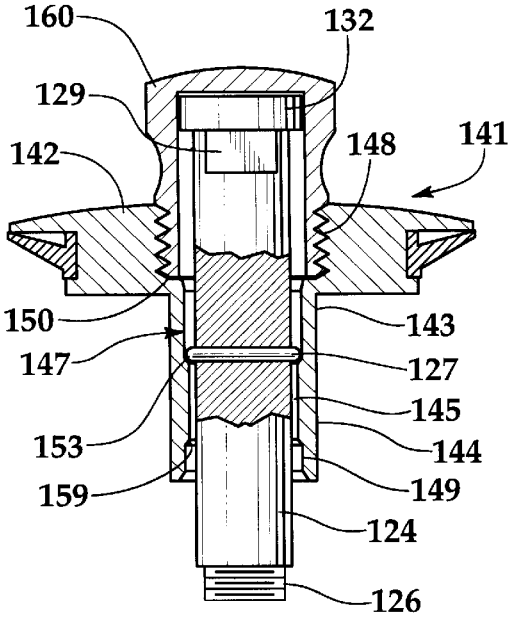
FIG. 2A is an enlarged partial section view illustrating the central bore of a stopper of the closure of FIG. 2.

Referring now to FIG. 2A, it may be seen more clearly that the second portion 147 of the central bore 146 includes a stepped profile. The second portion 147 of the stopper may be divided into an upper portion 143, with an internal diameter larger than the internal diameter of the middle section 145, and a lower section 149 with an internal diameter larger than the middle section. An annular upwardly facing chamfered shoulder 153 is formed where the upper portion 143 meets the middle section 145. An annular downwardly facing chamfered shoulder 159 is formed where the middle portion 145 meets the lower portion 149. The internal diameter of the upper portion 143 and lower portion 149 of the central bore may be larger than the outside diameter of the post 124 in combination with the projecting portion of the polymeric pin 127 mounted therein, such that when the stopper is fully open or fully closed the polymeric pin lands in the lower 149 or upper 143 portions of the bore 146 and is not in compression. Referring to FIG. 3A, when the stopper is in the open position the annular shoulder 159 will land on the projecting portion of pin 127 and hold the stopper in the open position. Referring to FIG. 2A, when the stopper is in the closed position, the polymeric pin 127 will land on annular shoulder 153 and, working in combination with gravity, will hold the stopper in the closed position. When stopper 141 is not fully open or closed, the internal stopper surface of middle section 145 compresses polymeric pin 127 due to the interference fit between the pin and stopper and retains the stopper in position.

Returning to FIGS. 1–4, the first portion 148 of the central bore 146 of the stopper 141 is closed by a knob 160 as described hereinafter in the assembly section. The stopper head 142 is larger in diameter than the drain passage 115 provided within the strainer body 110. A polymeric flange gasket 152 is disposed in an annular groove 154 on the upper end of the stopper and below the lower surface of the closure flange 139. The upper surface of the flange gasket 152 contacts the lower surface of the closure flange, and the lower surface contacts the flange 116 of the strainer 110 when the stopper is in the closed position to seal the drain. It should be understood that the flange gasket 152 is optional and is not necessary for a satisfactory seal, although it does provide some added protection against leakage. The closure may instead by equipped with an O-ring or another type of annular sealing element, or it may be constructed to seal the drain passage without any separate sealing element at all. The closure of the present invention does not depend upon any particular seal to work effectively.

Figure 3:
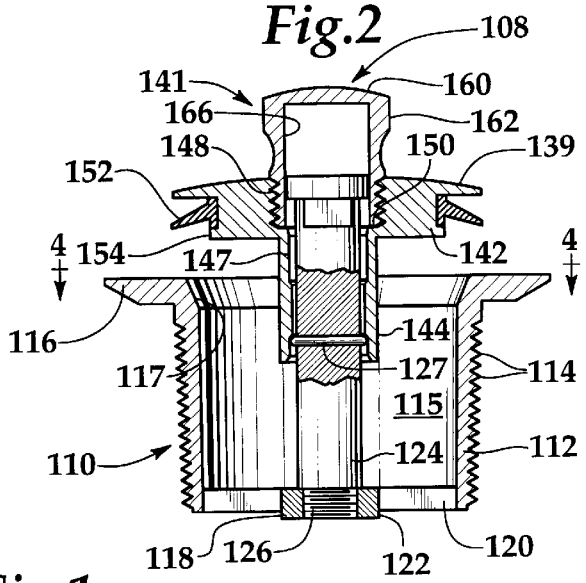
FIG. 3 is a sectional view similar to FIG. 2, but showing the closure raised to the open position.
Figure 3A:
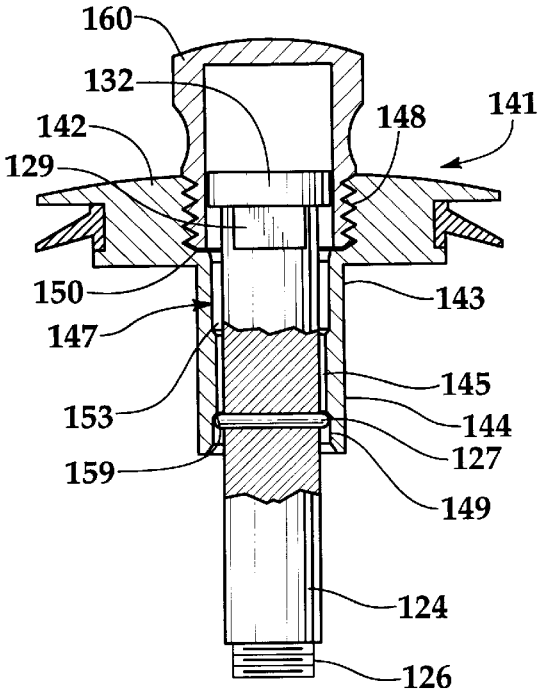
FIG. 3A is an enlarged partial section view illustrating the central bore of a stopper of the closure of FIG. 3.

In the open position of the closure shown in FIG. 3, the stopper head is displaced well above the top of the strainer body, and the drain is then opened for drainage of liquid from the bathtub or other vessel equipped with the drain closure.

In assembling the closure 108, the stopper 141 is applied to the bottom end of post 124, and the enlarged head 132 of the post is able to enter the first threaded portion 148 but not the smaller diameter second portion 147 of bore 146. The head 132 (or alternatively nut 133 or nut 135 of FIG. 9A or 9B) prevents the stopper 141 from being lifted off the top of the post 124 or moving upwardly on the post beyond the position shown in FIG. 3.

The first portion 148 of bore 146 is closed by the knob 160 having a knurled exterior surface 162. The lower end of the knob is externally threaded at 164, in order to mate with the internal thread formed in the first portion 148 of bore 146. When the knob 160 is threaded into the stopper head 142, it closes the top end of bore 146 and encloses the head 132 of the post 124. Extending upwardly into knob 160 is an internal blind passage 166 having a slightly larger diameter than the post head 132. The head 132 of post 124 is accommodated within passage 166, as best shown in FIG. 2. The knob 160 facilitates lifting of the stopper and inhibits closure theft, as will be explained more fully.

Figure 4:
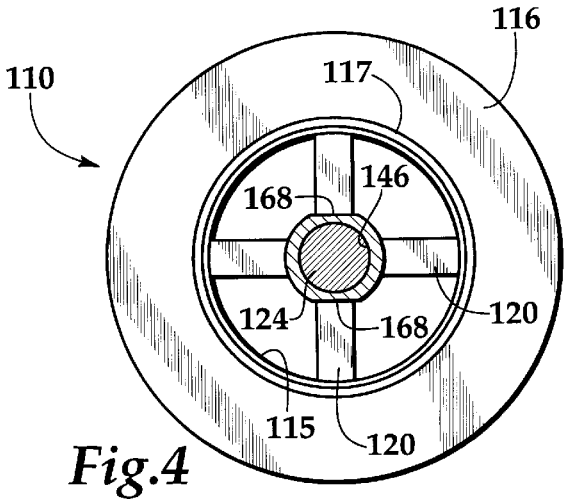
FIG. 4 is a sectional view taken generally along line 4—4 of FIG. 3 in the direction of the arrows.

With particularly reference to FIGS. 1 and 4, the sleeve 144 is provided with flat opposite sides 168 for receiving a standard open end wrench. As best shown in FIG. 3, the sleeve 144 and its flat sides 168 are exposed sufficiently to receive a wrench only when the stopper is in the fully open position. By applying a wrench to the flat sides 168, the stopper assembly can be held in place while knob 160 is threaded tightly into the stopper by applying pliers or another tool to the knurled portion 162 of the knob. When the knob has been fully tightened on the stopper, it appears to be an integral part of the stopper rather than a separate part as it actually is.

The drain closure is installed by first applying the stopper 141 to the post 124 and then threading the lower end 126 of the post into ring 118 of the strainer body. The knob 160 is then threaded onto the top of the stopper to complete the installation. Once installed, the stopper 141 cannot be removed from post 124 until the knob 160 has first been removed and post 124 has been disconnected from the strainer body 110.

During a normal installation, the installer grasps the stopper 141 in one hand and threads on the knob 160 with the other hand, and then further tightens the knob with pliers or a wrench. For additional protection against closure theft, the installer may apply a standard open end wrench to the flat sides 168 of sleeve 144 in order to hold the stopper while the knob 160 is further tightened with pliers or a wrench.

Assuming that normal installation has occurred, the possibility of closure theft is very remote since most closure thefts are spur of the moment and are accomplished without the use of any tools. Very few people have a strong enough grip to unscrew the knob 160 which is necessary for closure removal. In addition, the knob 160 and the stopper 141 appear to be a single integral piece, similar to most lift and turn closures now on the market. This alone deters some closure thefts. In order to remove post 124, it must be threaded out of the ring 118, and the post is not accessible for turning. The stopper 141 turns on the post to frustrate any attempt to unscrew the post by turning the stopper.

In use of the drain closure 108, the stopper 141 can be moved to the closed position of FIG. 2 simply by pressing downwardly with hand or foot on the stopper or knob 160. The stopper then slides downwardly until the flange gasket 152 is flattened and seals tightly against the flange 116 of the strainer body.

Alternatively, the present invention may be manufactured without the stepped profile sections 143, 145 and 149 of the second portion 147 of the bore 146. In such a configuration, polymeric pin 127 is maintained at all times under virtually the same amount of compression and is not stretched and compressed each time the unit is cycled between the open and closed positions. Consequently, the polymeric pin 127 is not subject to fatigue or other failure due to cycling and it can continue to maintain the same force against the surface or the bore 146 virtually indefinitely.

It is thus apparent that the unique drain closure of this invention takes full advantage of the desirable features of both foot and hand actuated closures without any of the disadvantages of either type of unit. The construction is simple and reliable. There is no tendency for the closure assembly to stick or jam and it is able to withstand repeated blows without being damaged. The closure 108 of the present invention has a smoother opening and closing action than prior art stoppers because the plastic to metal contact between the central bore of the metal stopper has less drag than that of the metal to metal or rubber to metal contact found in prior art closures of this type. Additionally, the plastic to metal contact will be less likely to score the metal surface of the central bore of the stopper.

The entire closure unit, including the strainer body 110, can be installed on both new and existing bathtubs and on other vessels such as sinks, laundry tubs and similar containers which must be drained. It is important to note that the stopper 141 and post 124 can be installed in an existing strainer body 110 in place of the foot operated closure that was originally in the strainer body. It is contemplated that the post and stopper will be provided in replacement kit form without the strainer body for installation in existing strainer bodies. The male threaded portions 126 and 128 of the post 124, having differing thread diameter sizes, provide versatility for use with strainers having varying diameters of the female thread 122 of ring 118. In order to carry out the replacement, the existing stopper assembly is removed from the strainer body and the new closure is installed in the strainer body in place of the old closure assembly.

Referring now to FIGS. 5–8 wherein there is illustrated a second embodiment of a drain closure 208 for use with a conventional strainer 210. The second embodiment includes many parts having similar structure and function as in the first embodiment. Parts having such similar structure and function are assigned like reference numerals except in the 200 series of numbers instead of the 100 series of numbers as in the first embodiment.

A strainer 210 includes a cylindrical wall 212 which is externally threaded at 214 for threadedly engaging a drain fitting under the floor of a bathtub (or a sink, laundry tub or other drain opening). Within the strainer body, a drain passage 215 is provided for draining of liquid from the tub. The top edge of the strainer body 210 is provided with an annular flange 216. The top or entry to passage 215 is tapered or beveled as indicated by numeral 217, although it need not be. Formed within the lower portion of the strainer body is a ring 218 carried on a spider 220 secured to the inside surface of the wall 212. The ring 218 is concentric with wall 212 and has an internal thread 222. The strainer 210 is preferably formed from metal; however, it may be formed from durable polymeric materials as well.

The drain closure 208 includes a polymeric post 224 having a male thread 226 on its bottom end that mate with the female thread 222 of ring 218 of the strainer 210. The post 224 can thus be threaded into ring 118 and mounted in this manner to extend along the central axis of the strainer. The main body of the post is cylindrical. A flat head 232 is formed on the upper end of post 224. The head 232 is enlarged in diameter compared to the shank of post 224.

Figure 10A:
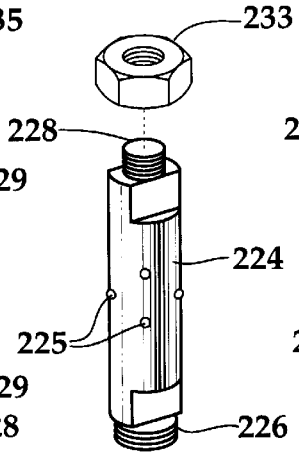
FIG. 10A is a perspective view illustrating an alternative embodiment of the post of the drain closure of FIG. 5.
Figure 10B:
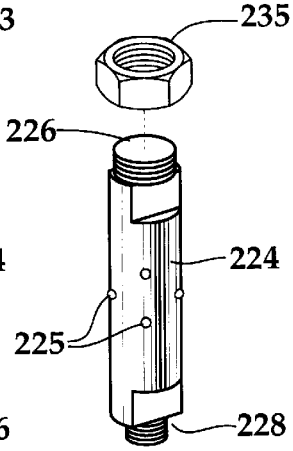
FIG. 10B is a perspective view illustrating the post of FIG. 10A reversed bottom to top.
Figure 5:
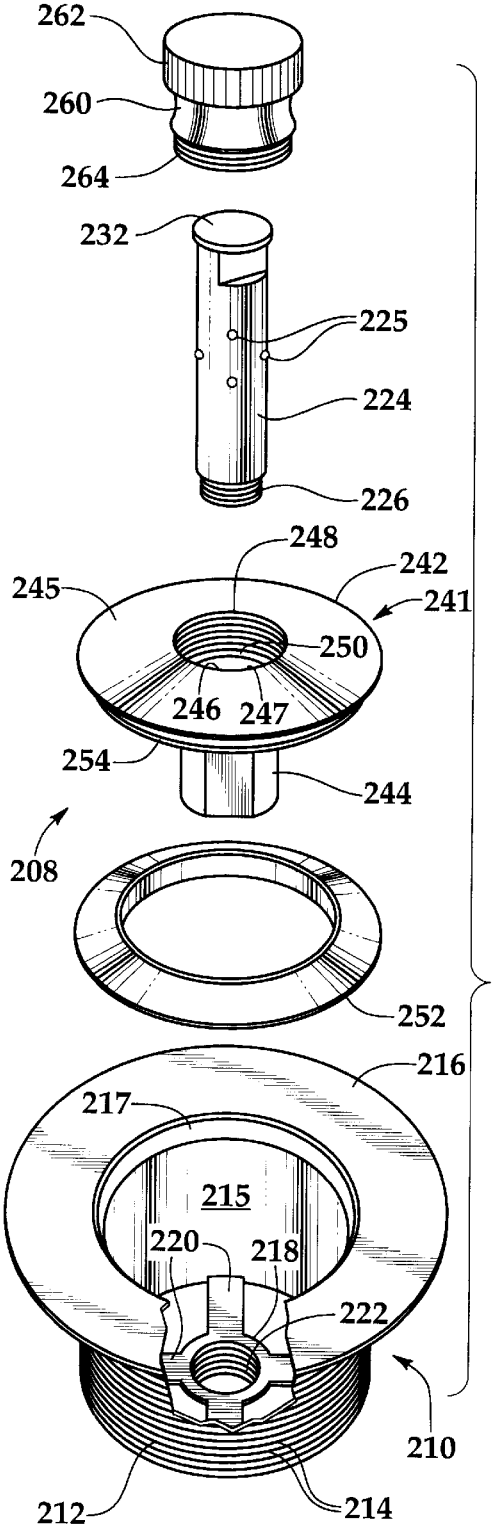
FIG. 5 is an exploded perspective view of a second embodiment of the bathtub drain closure constructed according to the present invention.

Referring to FIGS. 10A and 10B, alternatively, instead of an integrally formed head 232, the post 224 may be threaded on the top end with a thread 228 of different diameter than the bottom thread 226 and a nut 233 threaded thereon, wherein the nut 233 serves as the enlarged head. This manner of construction has the added advantage that the thread size 228 selected for the top of the post may be different from that of the thread size 226 of the lower portion. The nut 233 may be removed and the post 224 reversed top to bottom and the formerly upper end threadedly engaged in a strainer 210 having a different thread size 222 in the ring 218. A nut having a mating thread size 235 may be threaded on the former bottom end 226 of the post (now the upper end) and serve as the head. Thereby, the present invention may be retro-fitted on pre-existing tub strainers having internal threads of different sizes.

Referring again to FIGS. 5–8, the molded polymeric post 224 further includes a plurality of convex protuberances (herein referred to as "bumps") 225 disposed on the post approximately 120 degrees apart. It will be understood by those skilled in the art that the bumps 225 may be arranged in any spacing and are not required to have circular transverse cross sections but may be square, rectangular, oval or "X" shaped.

In the preferred embodiment, the post is formed from molded acetal resin (either homopolymer or copolymer); however, it will be understood by those skilled in the art that the post may be formed from ultra high density polyethylene (UHDPE), ultra high density polypropylene (UHDPP), polyester, ultra high molecular weight (UHMW) polymers including polyamides (NYLON®) and polytetrafluorethylene (Teflon®), or other similarly effective wear resistant polymeric resins.

Fitted on the post 224 is a forged brass or other metal stopper 241 having a disk shaped head 242 and an integral sleeve 244 projecting from its lower surface. The head 242 has an enlarged closure flange 245 forming its top surface. A cylindrical bore 246 is formed centrally through the stopper 241. A first portion 248 of the bore 246, disposed at the upper end of the bore 246, within head 242, is larger than the remainder of the bore and is internally threaded. An upwardly facing annular shoulder 250 is formed within the bore 246 at the lower end of the first portion 248 where it intersects with a second portion 247 of the central bore.

Figure 6:
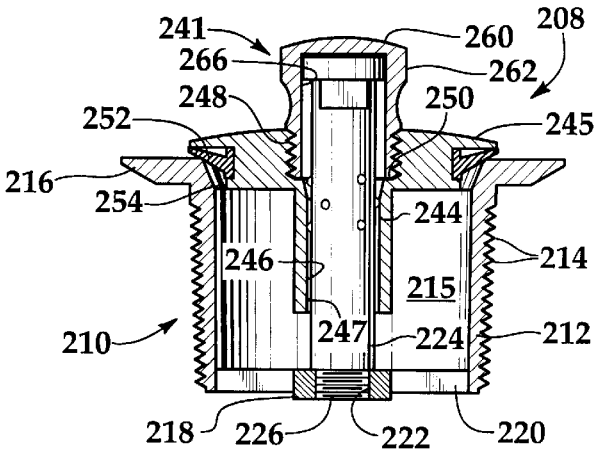
FIG. 6 is a sectional view of the assembled second embodiment of the drain closure of FIG. 5 taken on a vertical plane and showing the closure in the closed position.

The second portion of the bore 246 has a slightly larger diameter than the post 224, and the stopper 241 is received on post 224 for up and down sliding movement thereon between the open position (FIG. 7) and the closed position (FIG. 6). At the same time, the close fit of bore 246 on post 224 prevents the stopper assembly from wobbling. In addition, the fit of post 224 in bore 246 permits the stopper 241 to turn about the axis of the vertical post 224.

The stopper 241 is closed by knob 260 having a knurled exterior surface 262. The lower end of the knob is externally threaded at 264, in order to mate with the internal thread formed in the first portion 248 of bore 246. When the knob 260 is threaded into the stopper head 242, it closes the top end of bore 246 and encloses the head 232 of the post 224. Extending upwardly into knob 260 is an internal blind passage 266 having a slightly larger diameter than the post head 232. The head 232 of post 224 is accommodated within passage 266, as best shown in FIG. 6. The knob 260 facilitates lifting of the stopper.

The stopper head 242 is larger in diameter than the drain passage 215 provided within the strainer body 210. A polymeric flange gasket 252 is disposed in an annular groove 254 on the upper end of the stopper and below the lower surface of the closure flange 245. The upper surface of the flange gasket 252 contacts the lower surface of the closure flange, and the lower surface contacts the flange 216 of the strainer 210 when the stopper is in the closed position to seal the drain. The bumps 225 on post 224 also help to maintain the closure 208 in the closed position and thereby effects a more reliable seal between the stopper and the strainer body.

Figure 7:
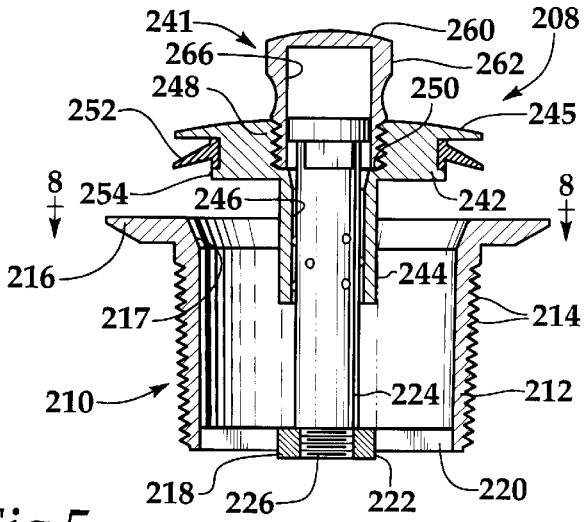
FIG. 7 is a sectional view similar to FIG. 6, but showing the closure raised to the open position.
Figure 8:
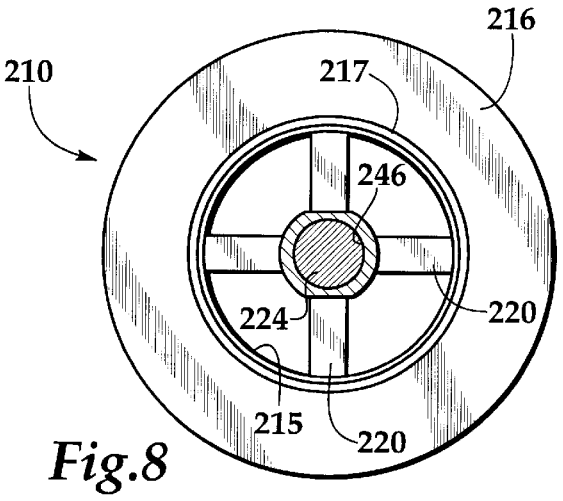
FIG. 8 is a sectional view taken generally along line 8—8 of FIG. 7 in the direction of the arrows.

In the open position of the closure shown in FIG. 7, the stopper head 242 and flange gasket 252 are displaced well above the top of the strainer body, and the drain is then opened for drainage of liquid from the bathtub or other vessel equipped with the drain closure.

It should be understood that the flange gasket 252 is optional and is not necessary for a satisfactory seal, although it does provide some added protection against leakage. The closure may instead by equipped with an O-ring or another type of sealing element or it may be constructed to seal the drain passage without any separate sealing element at all. The closure of the present invention does not depend upon any particular seal to work effectively.

The second portion 247 of bore 246 has a slightly larger diameter than the post 224, and the stopper 241 is received on post 224 for up and down sliding movement thereon between the open position (FIG. 7) and the closed position (FIG. 6). At the same time, the close fit of bore 246 on post 224 prevents the stopper assembly from wobbling. In addition, the fit of post 224 in bore 246 permits the stopper 241 to turn about the axis of the vertical post 224. When stopper 241 is fitted on post 224, the internal stopper surface compresses the bumps 225 of post 224 due to the interference fit therebetween. It will be understood by those skilled in the art that the second portion 247 of the bore 246 may alternatively include a stepped profile as described in connection with the first embodiment. In such an alternative configuration, all or a portion of the bumps 225 may land in a larger diameter bore analogous to the bore 143 and 149 of (FIGS. 2A and 3A), where the bumps 225 may function to hold the stopper in an open or closed position as heretofore described with regard to the first embodiment.

The second embodiment of the present invention is assembled and operates in a like manner as the first embodiment of the present invention. The second embodiment includes the advantages over the prior art heretofore discussed with regard to the first embodiment. Additionally, the polymeric material is used for pin 127 of the first embodiment and the polymeric material of the post 224 of the second embodiment is superior to prior art synthetic rubber O-rings used for interference fit engagement because such rubber is much more susceptible to wear and degradation than the materials of the present invention.

Although a first and a second embodiment of the invention has been illustrated in the accompanying Drawings and described in the foregoing Detailed Description, it will be understood that the invention is not limited to the embodiment disclosed but is capable of numerous modifications without departing from the scope of the invention as claimed.

I claim:

1. A drain closure for use in a drain having a strainer, said strainer having a top annular flange and an internally threaded opening disposed in the bottom, said drain closure comprising:

a post including:

an enlarged head, a lower portion externally threaded for engagement with the internally threaded opening in the bottom of the strainer, and at least one passageway passing through the post transverse to a longitudinal axis of the post;

a polymeric pin disposed in the transverse passageway wherein each end of the polymeric pin projects beyond the exterior surface of the post; and a stopper mounted on said post for sliding movement thereon between open and closed positions, said stopper having a stepped central bore, with upper and lower portions having a diameter greater than the pin length and a middle portion having a diameter slightly less than the pin length, wherein said ends of said polymeric pin are compressed to frictionally engage said stopper as the stopper is moved between the closed and open positions.

2. The drain closure of claim 1 wherein the post is metal and the polymeric pin is formed from a material selected from the group consisting of ultra high density polyethylene (UHDPE), ultra high density polypropylene (UHDPP), polyester, homopolymer acetal resin, copolymer acetal resin and ultra high molecular weight (UHMW) polymers including polyamides.

3. The drain closure of claim 1 wherein the post is metal and the polymeric pin is formed from a material selected from the group consisting of polytetrafluorethylene.

4. The drain closure of claim 1 wherein the head of the post is formed integrally thereon.

5. The drain closure of claim 1 wherein the post includes:

said lower portion being threaded with a first size male thread for engagement with the internally threaded opening in the bottom of the strainer;

an upper portion threaded with a second size male thread; and said head having an opening with a female thread sized for receiving the male thread of the upper portion of the post.

6. The drain closure of claim 1 wherein the stopper further includes:

a sleeve portion surrounding the central bore, said sleeve portion including at least one wrench flat accessible by a wrench when the stopper is in the open position, said wrench flat facilitating tightening of said knob on said stopper.

7. The drain closure of claim 1 further including:

a closure flange having an upper and lower surface, said flange disposed on an upper end of the stopper, said flange having an external diameter larger than an internal diameter of the strainer; and a polymeric flange gasket having an upper and lower surface, said flange disposed on the upper end of the stopper and below the lower surface of the closure flange, wherein the upper surface of the flange gasket contacts the lower surface of the closure flange, and the lower surface contacts the flange of the strainer when the stopper is in the closed position to seal the drain.

8. A drain closure for use in a drain having a strainer, said strainer having an internally threaded opening disposed in the bottom, said drain closure comprising:

a post including:

a lower portion externally threaded for engagement with the internally threaded opening in the bottom of the strainer, at least one passageway passing through the post transverse to a longitudinal axis of the post, and an enlarged head disposed on a top end of said post;

a polymeric pin disposed in the transverse passageway wherein each end of the polymeric pin projects beyond the exterior surface of the post;

a stopper including:

a central internal bore mounted on said post for sliding movement thereon between open and closed positions, a first portion at least partially internally threaded disposed at the upper end of the central bore, said first portion having an internal diameter larger than a diameter of the head of the post, and a second portion of the bore disposed below the first, said second portion having an internal diameter smaller than the diameter of the head of the post, wherein said head on said post prevents said stopper from being lifted off of the post, said second portion of the bore further including:

an upper portion with an internal diameter larger than an internal diameter of a middle portion, a lower portion with an internal diameter larger than the internal diameter of the middle portion, an annular upwardly facing shoulder formed where the upper portion meets the middle portion, a downwardly facing annular shoulder formed where the middle portion meets the lower portion, wherein the internal diameter of the upper portion and lower portion is larger than an outside diameter of the post in combination with the projecting ends of the polymeric pin disposed in the transverse passageway, such that when the stopper is in the open position the downwardly facing annular shoulder lands on the projecting ends of the pin and holds the stopper in the open position, and when the stopper is in the closed position, the projecting ends of the polymeric pin land on the upwardly facing shoulder and working in combination with gravity holds the stopper in the closed position, and when the stopper is not filly open or closed, the projecting ends of said polymeric pin frictionally contact said stopper and maintain the stopper in a selected position until a predetermined force is applied to said stopper in a direction to move the stopper; and said drain closure further includes a knob having an internal cavity open to a bottom of the knob, said cavity having an internal diameter sufficient to receive the head of the post, said knob having an externally threaded lower portion for engaging in the internally threaded first portion of the bore of the stopper, said knob facilitating the lifting of said stopper to the open position, and said post is inaccessible for unscrewing from the strainer while the knob is threadedly engaged to the stopper.

* * * * *